US010803830B2

(12) United States Patent
Aogaki et al.

(10) Patent No.: US 10,803,830 B2
(45) Date of Patent: Oct. 13, 2020

(54) DEVICE AND METHOD FOR MURA CORRECTION

(71) Applicant: SYNAPTICS INCORPORATED, San Jose, CA (US)

(72) Inventors: Kazutoshi Aogaki, Tokyo (JP); Hirobumi Furihata, Tokyo (JP); Hirohisa Tsuchida, Tokyo (JP); Takashi Nose, Tokyo (JP)

(73) Assignee: SYNAPTICS INCORPORATED, San Jose, CA (US)

( * ) Notice: Subject to any disclaimer, the term of this patent is extended or adjusted under 35 U.S.C. 154(b) by 92 days.

(21) Appl. No.: 16/193,985

(22) Filed: Nov. 16, 2018

(65) Prior Publication Data

US 2019/0156786 A1 May 23, 2019

(30) Foreign Application Priority Data

Nov. 20, 2017 (JP) ..... 2017-222649

(51) Int. Cl.

| | |
|---|---|
| ***G09G 5/10*** | (2006.01) |
| ***G09G 3/20*** | (2006.01) |
| *G09G 3/36* | (2006.01) |
| *G09G 3/3208* | (2016.01) |

(52) U.S. Cl.

CPC ..... *G09G 5/10* (2013.01); *G09G 3/20* (2013.01); *G09G 3/2074* (2013.01); *G09G 3/3208* (2013.01); *G09G 3/36* (2013.01); *G09G 2310/027* (2013.01); *G09G 2320/0233* (2013.01)

(58) Field of Classification Search

None

See application file for complete search history.

(56) References Cited

U.S. PATENT DOCUMENTS

| | | | | |
|---|---|---|---|---|
| 2006/0061593 | A1* | 3/2006 | Miura | G09G 3/22 345/612 |
| 2016/0171939 | A1* | 6/2016 | Na | G09G 3/2003 345/690 |
| 2018/0040279 | A1* | 2/2018 | Kimura | B29C 45/261 |
| 2018/0343429 | A1* | 11/2018 | Kim | G09G 5/10 |

FOREIGN PATENT DOCUMENTS

| | | |
|---|---|---|
| JP | 2016085344 A | 5/2016 |

* cited by examiner

*Primary Examiner* — Christopher J Kohlman

(74) *Attorney, Agent, or Firm* — Patterson + Sheridan, LLP

(57) ABSTRACT

A device and method for correcting mura within a display device. The device may include a display driver that includes lookup table circuitry, correction amount calculation circuitry, and mura correction circuitry. The lookup table circuitry is configured to calculate a second grayscale value for a second display brightness value (DBV), the second grayscale value being determined to achieve a brightness level corresponding to a first grayscale value and a first DBV. The correction amount calculation circuitry is configured to calculate a mura correction amount based on a mura correction data for the second grayscale value and the second DBV. Further, the mura correction circuitry is configured to perform a mura correction on input image data by using the mura correction amount.

20 Claims, 6 Drawing Sheets

DEVICE AND METHOD FOR MURA CORRECTION

CROSS REFERENCE

This application claims priority to Japanese Patent Application No. 2017-222649, filed on Nov. 20, 2017, the disclosure of which is incorporated herein by reference in its entirety.

BACKGROUND

Field

The present disclosure relates to a display driver, display device and method for performing mura correction.

Description of the Related Art

Display panels, such as liquid crystal display panels and organic light emitting diode display panels, are used in electronic appliances such as notebook computers, desktop computers, and smart phones. However, in many instances, the display panels may experience display mura. Thus there is a need for a display driver configured to correct display mura in a display panel.

SUMMARY

In one or more embodiments, a display driver includes lookup table circuitry, correction amount calculation circuitry, and mura correction circuitry. The lookup table circuitry is configured to calculate a second grayscale value for a second display brightness value (DBV). A brightness level corresponding to the second grayscale value corresponds to a brightness level corresponding to a first grayscale value and a first DBV. The correction amount calculation circuitry is configured to calculate a mura correction amount based on a mura correction data for the second grayscale value and the second DBV. The mura correction circuitry is configured to perform mura correction on input image data based on the mura correction amount.

In one embodiment, a display device comprises a display panel, lookup table circuitry, correction amount calculation circuitry, mura correction circuitry, and drive circuitry. The lookup table circuitry is configured to calculate a second grayscale value for a second DBV. The brightness level corresponding to the second grayscale value corresponds to a brightness level corresponding to a first grayscale value and a first DBV. The correction amount calculation circuitry is configured to calculate a mura correction amount based on a mura correction data for the second grayscale value and the second DBV. The mura correction circuitry is configured to perform mura correction on input image data based on the mura correction amount. The drive circuitry is configured to drive the display panel based on an output from the mura correction circuitry.

In one embodiment, a method comprises calculating a second grayscale value for a second DBV, and calculating a mura correction amount based on a mura correction data for the second grayscale value and the second DBV. A brightness level corresponding to the second grayscale value corresponds to a brightness level corresponding to a first grayscale value and a first DBV.

BRIEF DESCRIPTION OF THE DRAWINGS

So that the manner in which the above recited features of the present disclosure may be understood in detail, a more particular description of the disclosure, briefly summarized above, may be had by reference to embodiments, some of which are illustrated in the appended drawings. It is to be noted, however, that the appended drawings illustrate only some embodiments of this disclosure and are therefore not to be considered limiting of its scope, for the disclosure may admit to other equally effective embodiments.

DETAILED DESCRIPTION

In the following, a detailed description is given of various embodiments with reference to the drawings. It would be apparent that technologies disclosed herein may be implemented by a person skilled in the art without a further detailed description of these embodiments. For simplicity, details of well-known features are not described in the following.

Figure 1A:
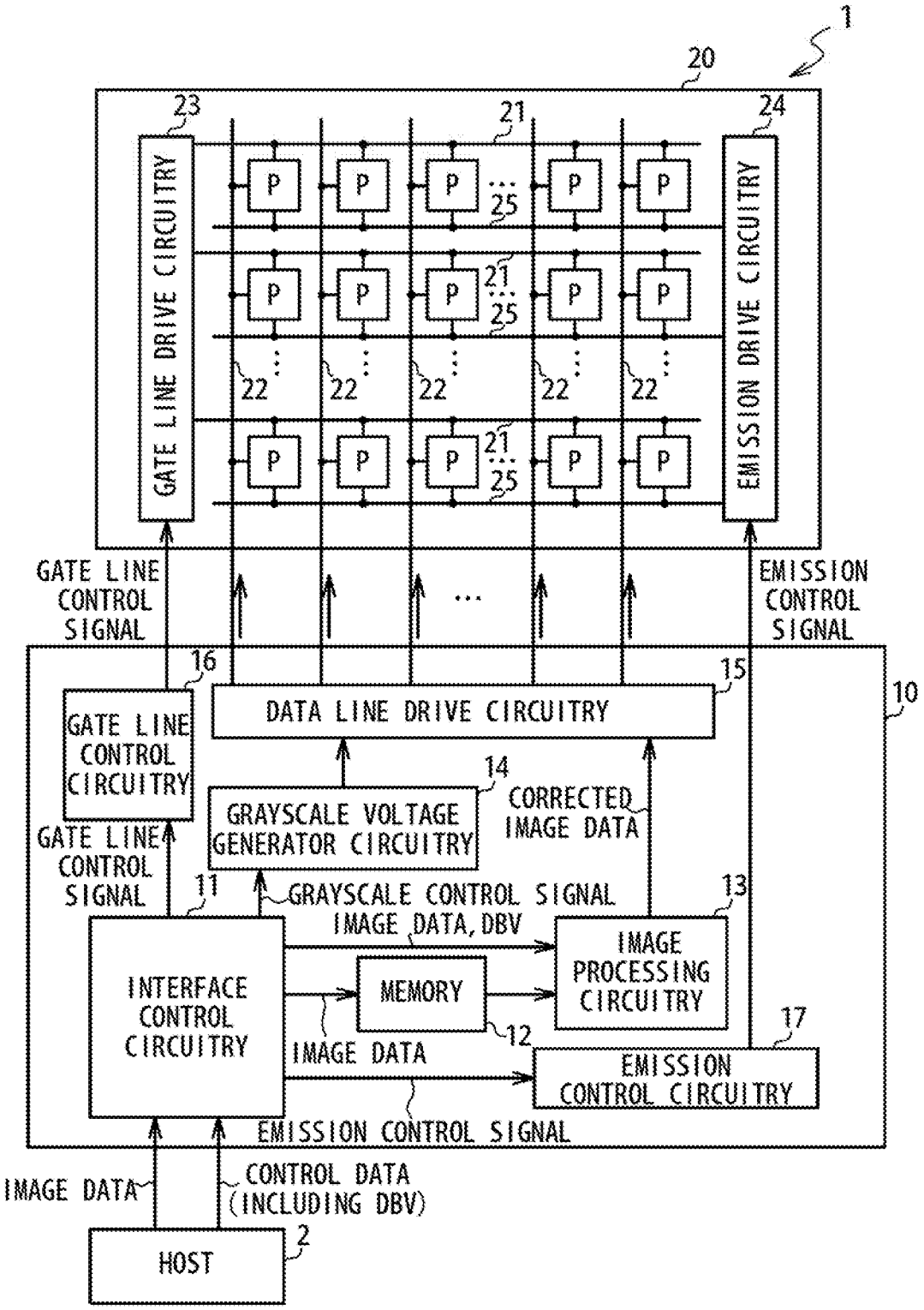
FIG. 1A is a block diagram illustrating an example configuration of a display device, according to one or more embodiments.

FIG. 1A is a block diagram illustrating an example configuration of a display device 1, according to one or more embodiments. The display device 1 comprises a display driver 10 and a display panel 20.

In one or more embodiments, the display device 1 is configured to provide a user with information on the display panel 20. The display device 1 is an example electronic appliance equipped with a display panel. The electronic appliance may be a portable electronic appliance, such as a smart phone, a laptop computer, a netbook computer, a tablet, a web browser, an electronic book reader and a personal digital assistant (PDA). The electronic appliance may be a device of any size and shape, such as a desktop computer equipped with a display panel and a display unit mounted on an automobile equipped with a display panel. The electronic appliance may comprise a touch sensor for touch sensing of an input object such as a user's finger and stylus.

Examples of the display panel 20 may include an organic light emitting diode (OLED) display panel and a liquid crystal display panel. In one or more embodiments, the display panel 20 comprises gate lines 21, data lines 22, gate line drive circuitry 23, emission drive circuitry 24, emission lines 25, and pixel circuits P.

Figure 1B:
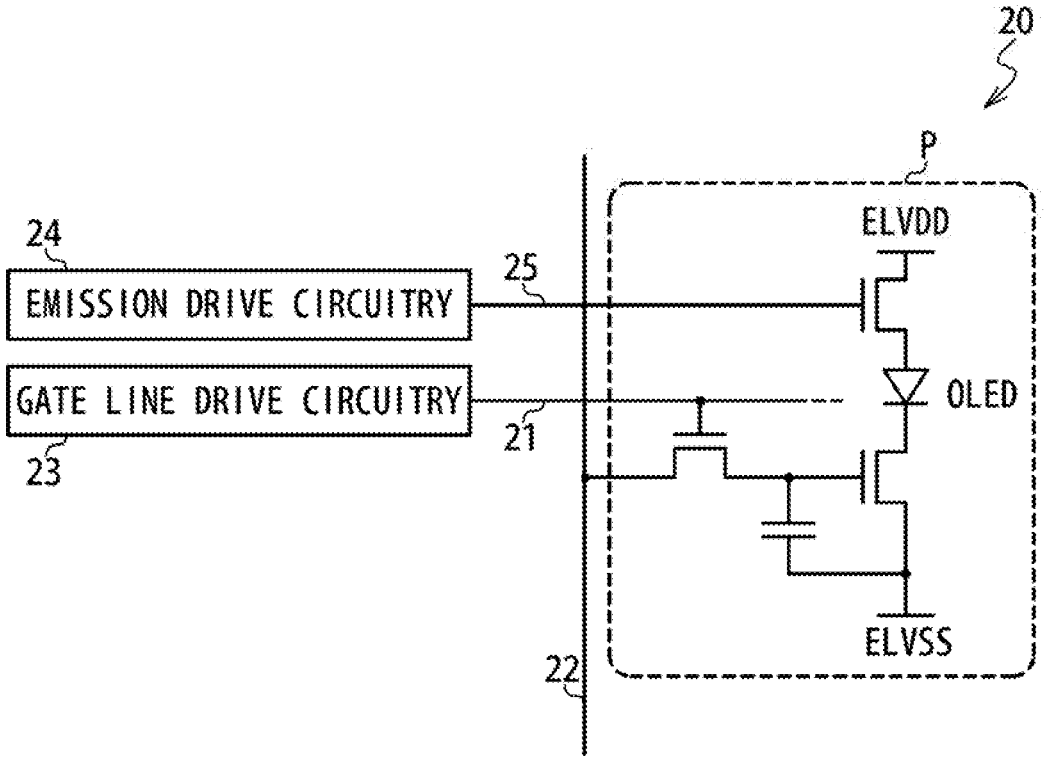
FIG. 1B is a block diagram illustrating an example configuration of a pixel circuit, according to one or more embodiments.

In one or more embodiments, as illustrated in FIG. 1B, each pixel circuit P, which is disposed at an intersection of a gate line 21 and a data line 22, is configured to display one of red, green and blue. In one or more embodiments, each pixel circuit P is connected to an emission line 25. In one or more embodiments, pixel circuits P displaying red, green, and blue are used as an R subpixel, a G subpixel, and a B subpixel, respectively.

In one or more embodiments, when an OLED display panel is used as the display panel 20, pixel circuits P displaying red, green and blue may comprise OLEDs which are light emitting elements configured to emit light of red, green and blue, respectively. In one or more embodiments, an OLED is configured to emit light when a potential difference is generated between a high-side power supply voltage ELVDD and a low-side power supply voltage ELVSS based on an emission signal received from the emission drive circuitry 24 to supply a current from the high-side power supply voltage ELVDD to the OLED.

Referring back to FIG. 1A, in one or more embodiments, the gate line drive circuitry 23 is configured to drive the gate lines 21 in response to a gate line control signal received from the display driver 10.

In one or more embodiments, the emission drive circuitry 24 is configured to drive the emission lines 25 in response to an emission control signal received from the display driver 10.

In one or more embodiments, the display driver 10 is configured to drive the display panel 20 in response to information received from a host 2 to display an image on the display panel 20.

In one or more embodiments, the display driver 10 comprises interface control circuitry 11, a memory 12, image processing circuitry 13, grayscale voltage generator circuitry 14, data line drive circuitry 15, gate line control circuitry 16 and emission control circuitry 17. Examples of the host 2 may include an application processor, a central processing unit (CPU) and a digital signal processor (DSP).

In one or more embodiments, the interface control circuitry 11 is configured to output image data and control data received from the host 2 to respective circuitry and the memory 12.

In one or more embodiments, the image data describe grayscale values of respective subpixels of respective pixels of an input image.

In one or more embodiments, the control data comprises commands and parameters used for controlling the display driver 10. In one or more embodiments, the control data comprises a display brightness value (DBV), which is a parameter specifying the overall brightness level of the displayed image. In one or more embodiments, the DBV is specified as a value ranging from "000" to "FFF" in the hexadecimal notation. For example, in one embodiment, a DBV of "FFF" indicates the maximum display brightness level, which corresponds to the brightest state, and a DBV of "000" indicates the minimum display brightness level, which corresponds to the darkest state.

In one or more embodiments, the memory 12 is configured to store the image data received from the interface control circuitry 11. The memory 12 may include, for example, a static random access memory (SRAM).

In one or more embodiments, the image processing circuitry 13 is configured to perform desired image data processing, including mura correction, on the image data received from the interface control circuitry 11 and output the corrected image data to the data line drive circuitry 15.

In one or more embodiments, the grayscale voltage generator circuitry 14 is configured to generate a set of grayscale voltages respectively corresponding to allowed grayscale values described in image data.

In one or more embodiments, the data line drive circuitry 15 is configured to drive the respective data lines with grayscale voltages corresponding to the grayscale values described in image data. For example, the data line drive circuitry 15 may be configured to select grayscale voltages corresponding to the grayscale values described in the image data received from the image processing circuitry 13, from among the grayscale voltages supplied from the grayscale voltage generator circuitry 14 and drive the respective data lines 22 to the selected grayscale voltages.

In one or more embodiments, the gate line control circuitry 16 is configured to output a gate line control signal to the gate line drive circuitry 23 to control the same.

In one or more embodiments, the emission control circuitry 17 is configured to output an emission control signal to the emission drive circuitry 24 to control the same.

In one or more embodiments, the display driver 10 may be configured to, when performing mura correction based on an input grayscale value, calculate a mura correction amount from the input grayscale value and a mura correction data to output a corrected grayscale value. In one embodiment, when the display driver 10 receives a DBV, the brightness level of each subpixel may change in response to the received DBV for a fixed grayscale value. In some embodiments, the subpixel is the pixel circuit P, and the grayscale voltage to be applied to the subpixel may change in response to the different DBVs for the fixed grayscale value. Further, as the degree of mura may be dependent on the grayscale voltage applied to the subpixel, the mura correction amount for the mura correction may be altered based on the DBV.

Mura Correction Process

Figure 2:
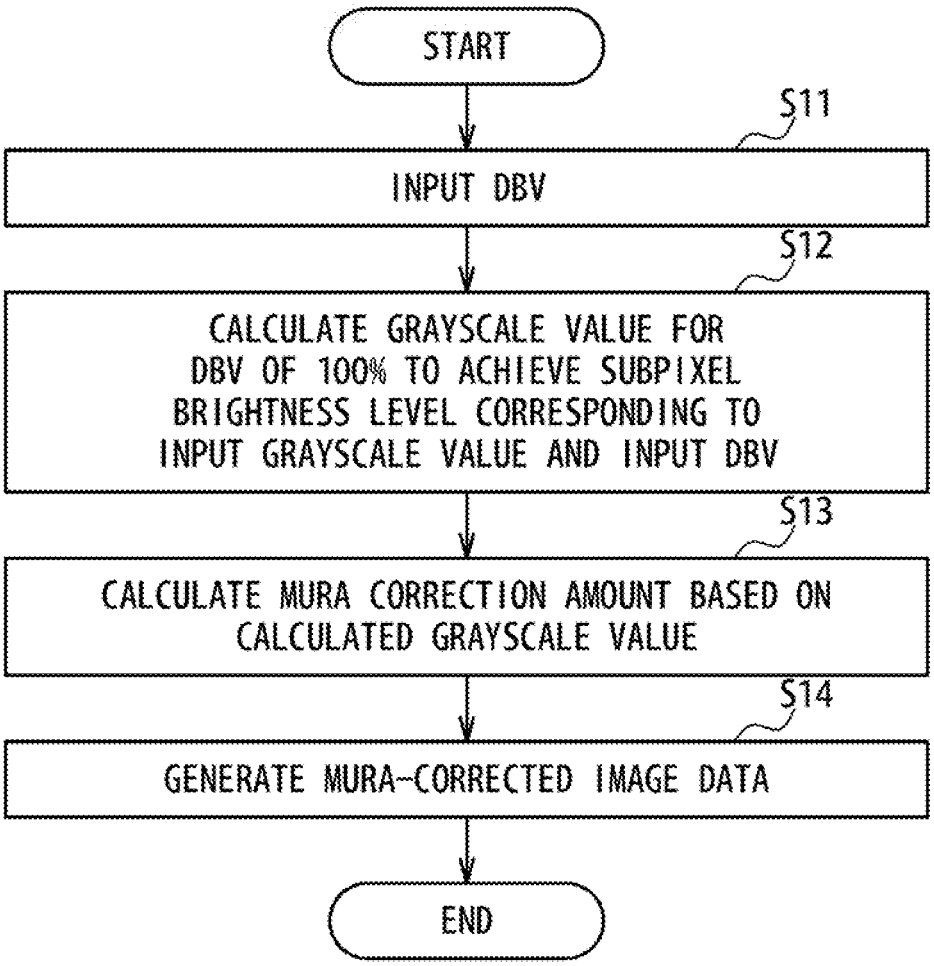
FIG. 2 illustrates an example procedure of mura correction, according to one or more embodiments.

In one or more embodiments, as illustrated in FIG. 2, a DBV is input to the display driver 10 at step S11.

In one embodiment, the grayscale value for a DBV of 100% is calculated at step S12 to achieve the subpixel brightness level corresponding to the input grayscale value and the input DBV so that the gamma value $\gamma$, which is a parameter representing a display property, remains unchanged. In one or more embodiments, the gamma value $\gamma$ is set, for example, to 2.2 for a display device equipped with a display panel, such as a liquid crystal display panel and an OLED display panel.

Figure 3:
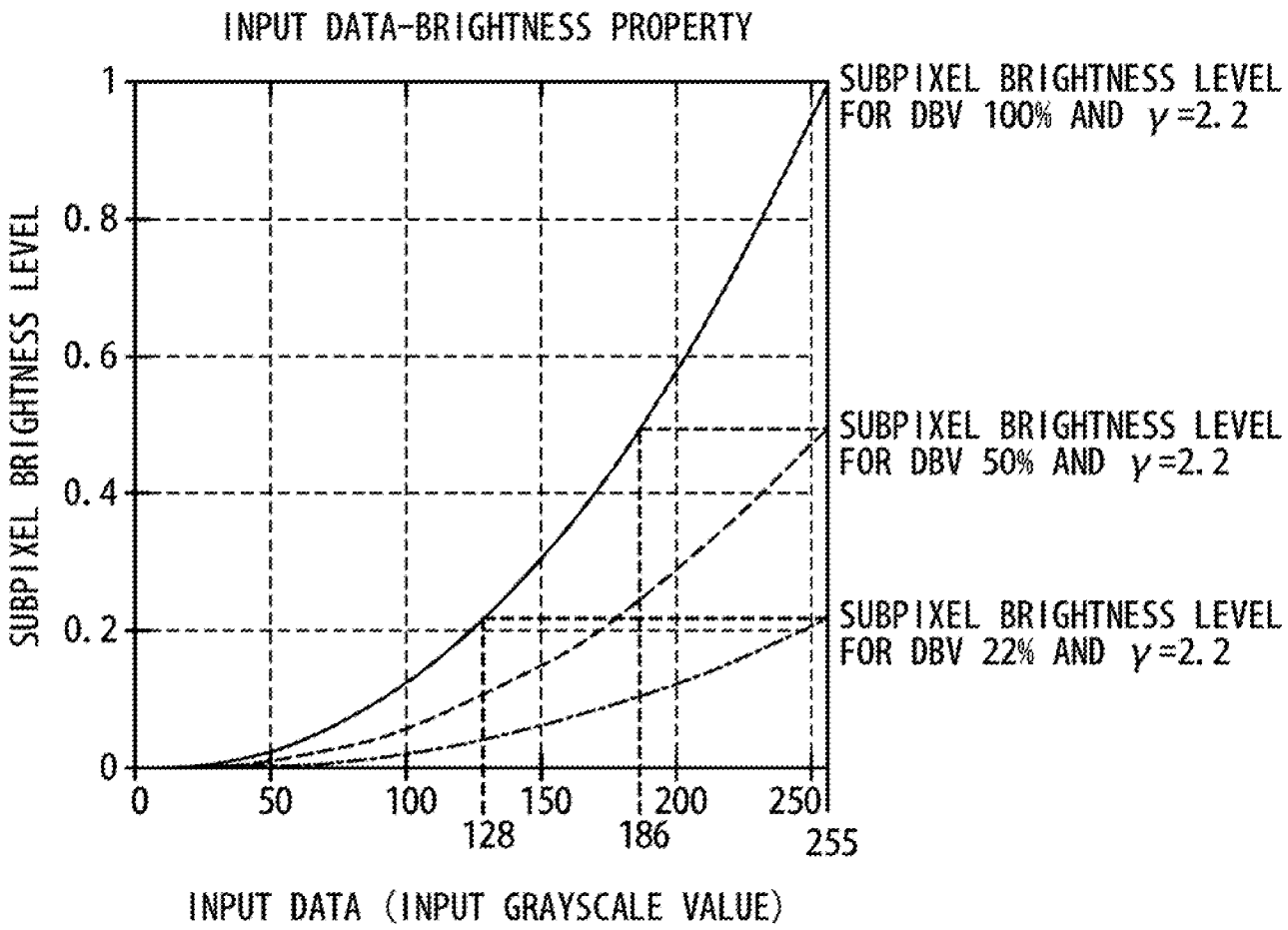
FIG. 3 illustrates an example input data-brightness property, according to one or more embodiments.

FIG. 3 illustrates an example graph representing the input data-brightness property, in which the horizontal axis represents the input data (input grayscale value) and the vertical axis represents the subpixel brightness level, according to one or more embodiments. FIG. 3 further illustrates the curves of the input data-brightness property for DBVs of 100%, 50% and 22%, respectively, when $\gamma$=2.2.

In one or more embodiments, as illustrated in FIG. 3, when the display brightness level is controlled for voltages applied to subpixels, the subpixel brightness level corresponding to a grayscale value of "255" for the DBV of 50% is equal to the subpixel brightness level corresponding to a grayscale value of "186" for the DBV of 100%.

In one or more embodiments, the subpixel brightness level for the DBV of 50% and the gamma value $\gamma$ of 2.2 may be calculated as 0.5×("input grayscale value")2.2=(0.51/2.2×"input grayscale value")2.2=(186/255×"input grayscale value")2.2. Accordingly, the grayscale value for the DBV of 100% to achieve the subpixel brightness level corresponding to the input grayscale value and the DBV of 50% may be calculated by multiplying the input grayscale value for the DBV of 50% by 186/255.

Similarly, the subpixel brightness level corresponding to a grayscale value of "255" for the DBV of 22% may be equal to the subpixel brightness level corresponding to a grayscale value of "128" for the DBV of 100%. In one embodiment, the same voltage is to be applied to the subpixel and the same degree of mura may be generated with respect to the grayscale value of "255" for the DBV of 22% and the grayscale value of "128" for the DBV of 100%.

In one or more embodiments, the subpixel brightness level for the DBV of 22% and the gamma value γ of 2.2 is calculated as 0.22×("input grayscale value")2.2=(0.221/2.2×"input grayscale value")2.2=(128/255×"input grayscale value")2.2. Accordingly, the grayscale value for the DBV of 100% to achieve the subpixel brightness level corresponding to the input grayscale value and the DBV of 22% may be calculated by multiplying the input grayscale value for the DBV of 22% by 128/255.

In one or more embodiments, the same grayscale voltage is applied to the subpixel with respect to the grayscale value of "255" for the DBV of 50% and the grayscale value of "186" for the DBV of 100%. In such an embodiment, the same degree of mura may be generated. In one or more embodiments, the same voltage is applied to the subpixel with respect to the grayscale value of "255" for the DBV of 22% and the grayscale value of "128" for the DBV of 100%. In such an embodiment, the same degree of mura is generated. Accordingly, the mura correction may be performed on the input grayscale value based on the mura correction amount for the grayscale value thus calculated for the DBV of 100%.

While in the above description describes the use of grayscale values in a range of 0-255, in other embodiments, other greyscale values having other ranges may be used. For example, greyscale values having an upper range limit that is less than 255 or greater than 255 may be utilized.

Referring back to FIG. 2, in one or more embodiments: at step S13, a mura correction amount is calculated, based on the grayscale value calculated at step S12 and the mura correction data for the DBV of 100% for each subpixel; and at step S14, a mura-corrected image data is generated by the mura correction based on the calculated mura correction amount for each subpixel.

Image Processing Circuitry

Figure 4:
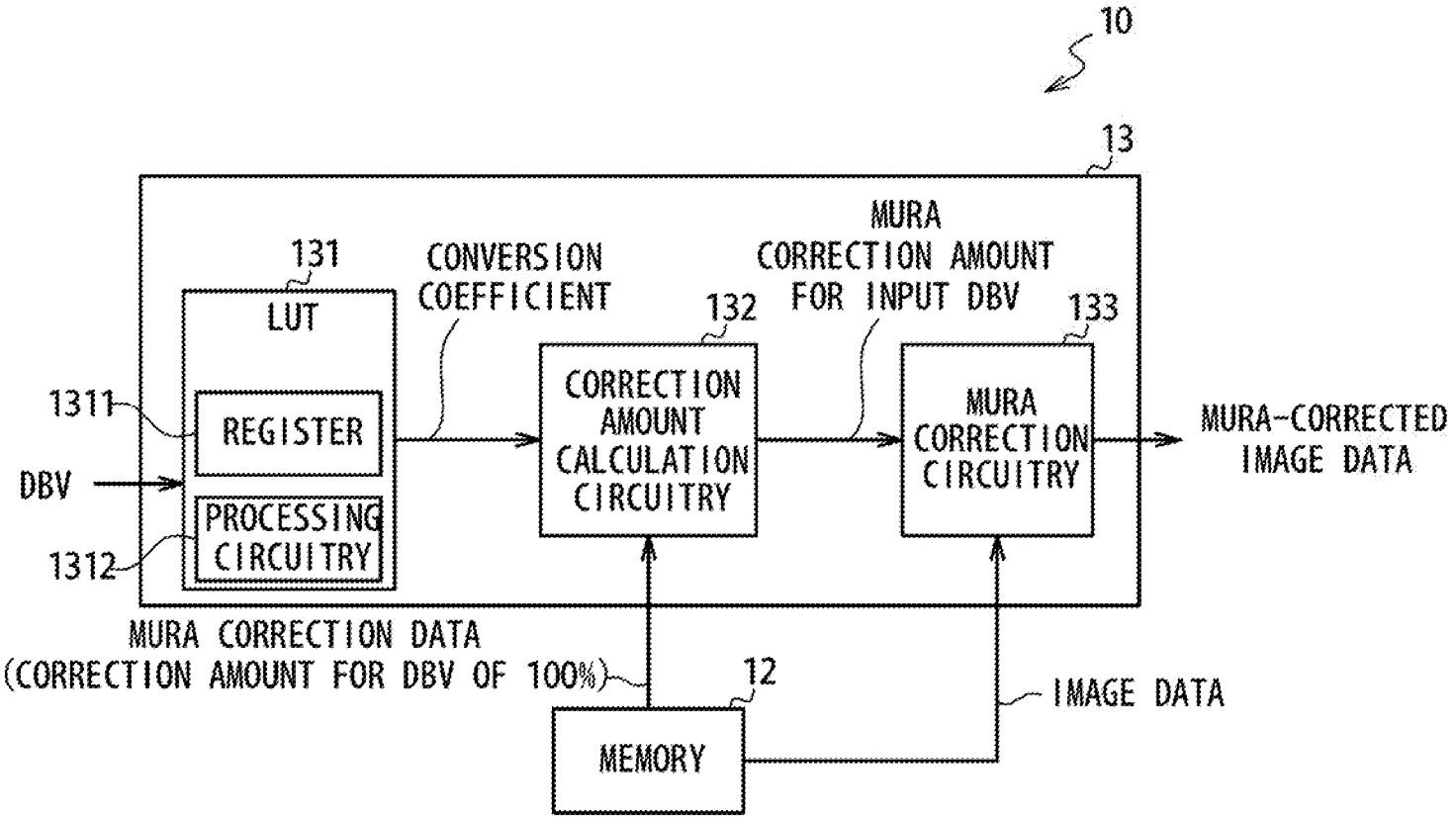
FIG. 4 is a block diagram illustrating an example configuration of image processing circuitry, according to one or more embodiments.

In one or more embodiments, as illustrated in FIG. 4, the image processing circuitry 13 comprises lookup table (LUT) circuitry 131, correction amount calculation circuitry 132 and mura correction circuitry 133. In one or more embodiments, the LUT circuitry 131 comprises a register 1311 and processing circuitry 1312. In one or more embodiments, some or all of the LUT circuitry 131, the correction amount calculation circuitry 132 and the mura correction circuitry 133 may be integrated in the display driver 10 outside of the image processing circuitry 13.

In one or more embodiments, the LUT circuitry 131 is configured to calculate the grayscale value for the DBV of 100% to achieve the subpixel brightness level corresponding to the input DBV and the input grayscale value. For example, the LUT circuitry 131 may be configured to convert the DBV received from the interface control circuitry 11 into a conversion coefficient. The conversion coefficient may be used to convert a mura correction amount calculated based on the mura correction data stored in the memory 12 for the DBV of 100% into a mura correction amount corresponding to the calculated grayscale value for the DBV of 100%.

In one or more embodiments, the register 1311 of the LUT circuitry 131 is configured to store a predetermined number of DBVs and conversion coefficients respectively associated with the stored DBVs. In the example illustrated in FIG. 5, conversion coefficients #1 to #5 are stored in the register 1311 for the DBVs #1 to #5, respectively. In one or more embodiments, the processing circuitry 1312 is configured to perform linear interpolation using the conversion coefficients stored in the register 1311 to calculate the conversion coefficient to be outputted, when a DBV is inputted to the LUT circuitry 131.

In one or more embodiments, the conversion coefficient may be calculated by calculating the grayscale value for the DBV of 100% through applying the gamma value, the input grayscale value and the DBV to the formula of the data-brightness property described above with reference to FIG. 3. In one or more embodiments, the use of the LUT circuitry 131 allows obtaining the conversion coefficient by using size-reduced circuitry, which may comprise several multipliers and a register storing conversion coefficients for a predetermined number of DBVs. This configuration effectively improves the circuit simplicity and reduces the memory capacity.

Figure 5:
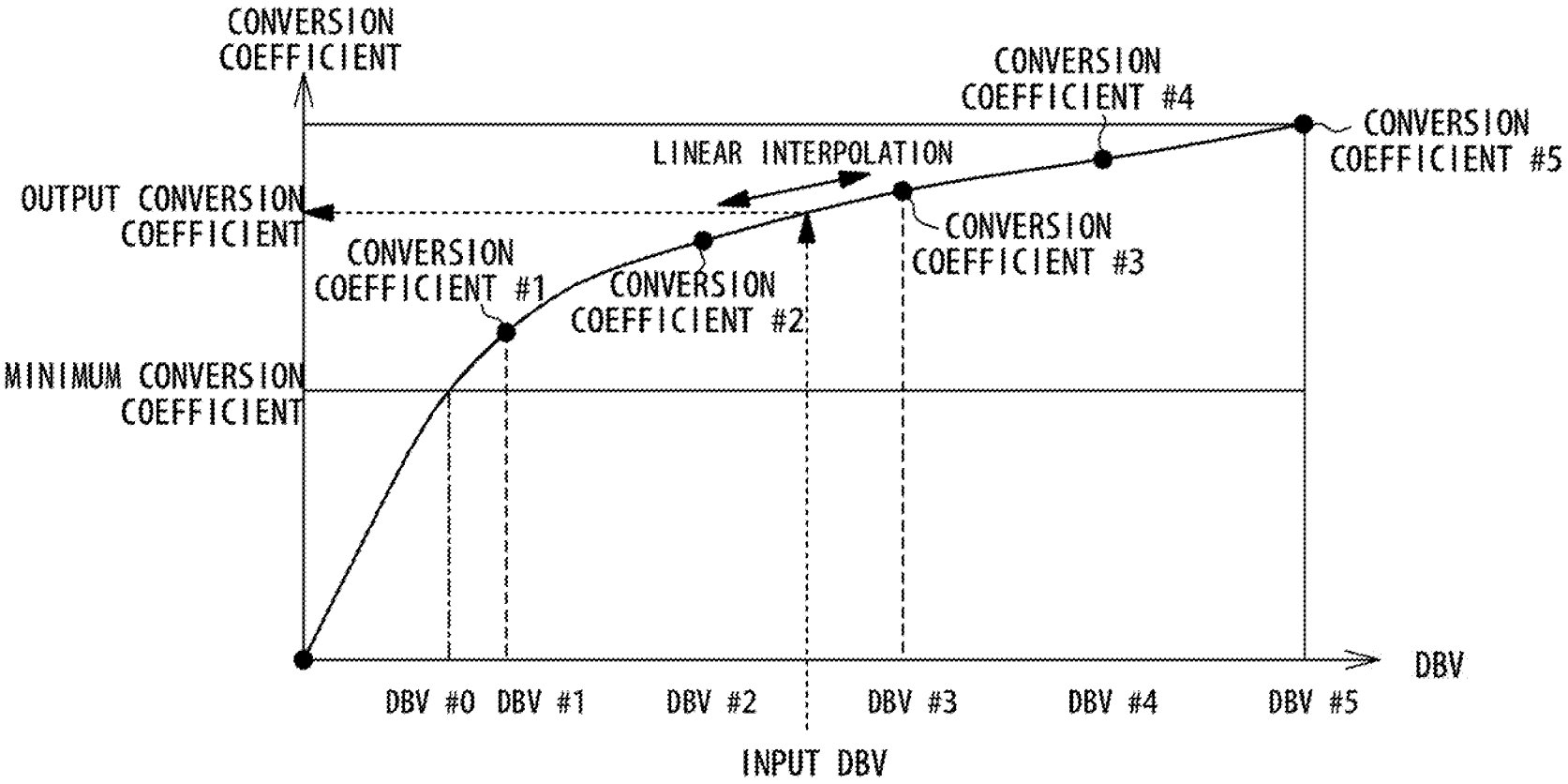
FIG. 5 illustrates an example relationship between DBVs inputted to lookup table (LUT) circuitry and conversion coefficients outputted from the LUT circuitry, according to one or more embodiments.

In one or more embodiment, the settings of the LUT circuitry 131 are adjusted in accordance with the analog voltage control setting. For a reduced DBV, the display brightness control may be achieved with the emission control signal, because the display brightness control based on the voltages applied to the respective subpixels (pixel circuits) may cause grayscale collapse. In such an embodiment, the conversion coefficient may be fixed, because the voltages to be applied to the subpixels are to be fixed for the respective grayscale values against changes in the DBV, and therefore the degree of mura remains unchanged. In one or more embodiments, as illustrated in FIG. 5, the LUT circuitry 131 sets the conversion coefficient to a minimum conversion coefficient so that the conversion coefficient is constant for DBVs equal to or smaller than DBV #0 of a given value.

Referring back to FIG. 4, in one or more embodiments, the LUT circuitry 131 outputs the calculated conversion coefficient to the correction amount calculation circuitry 132.

In one or more embodiments, the correction amount calculation circuitry 132 is configured to calculate a mura correction amount for a variable DBV based on the conversion coefficient and the mura correction data for the DBV of 100% stored in the memory 12. The correction amount calculation circuitry 132 may be configured to perform mura correction on the image data using the calculated mura correction amount to generate mura-corrected image data.

Although a limited number of embodiments have been described in the above, a skilled person benefited from this disclosure would appreciate that various other embodiments and variations may be conceived without departing from the scope of this disclosure. Embodiments and variations may be combined. Accordingly, the specification and drawings only provides an exemplary disclosure.

What is claimed is:

1. A display driver, comprising:

lookup table circuitry configured to calculate a second grayscale value for a second display brightness value (DBV), wherein a brightness level corresponding to the second grayscale value corresponds to a brightness level corresponding to a first grayscale value and a first DBV, wherein the first DBV differs from the second DBV;

correction amount calculation circuitry configured to calculate a mura correction amount based on a mura correction data for the second grayscale value and the second DBV; and mura correction circuitry configured to perform a mura correction on input image data based on the mura correction amount.

2. The display driver according to claim 1, further comprising a memory configured to store the mura correction data, wherein the correction amount calculation circuitry is further configured to read out the mura correction data to calculate the mura correction amount for the second grayscale value.

3. The display driver according to claim 1, wherein the lookup table circuitry is further configured to convert the first DBV inputted thereto into a conversion coefficient used to convert the mura correction data into the mura correction amount for the second grayscale value, and wherein the correction amount calculation circuitry is further configured to calculate the mura correction amount based on the conversion coefficient and the mura correction data.

4. The display driver according to claim 1, wherein the lookup table circuitry comprises:

a register configured to store conversion coefficients respectively associated with a plurality of DBVs; and processing circuitry configured to:

receive the first DBV; and calculate a first conversion coefficient for the first DBV based on a linear interpolation of the plurality of DBVs and the conversion coefficients.

5. The display driver according to claim 4, wherein the first conversion coefficient is a minimum conversion coefficient for the first DBV which is smaller than a predetermined DBV.

6. The display driver according to claim 1, wherein the second DBV is a maximum DBV.

7. The display driver according to claim 1, wherein the first DBV includes an externally received DBV.

8. A display device comprising:

a display panel;

lookup table circuitry configured to calculate a second grayscale value for a second display brightness value (DBV), wherein a brightness level corresponding to the second grayscale value corresponds to a brightness level corresponding to a first grayscale value and a first DBV, wherein the first DBV differs from the second DBV;

correction amount calculation circuitry configured to calculate a mura correction amount based on a mura correction data for the second grayscale value and the second DBV;

mura correction circuitry configured to perform a mura correction on input image data based on the mura correction amount; and driver circuitry configured to drive the display panel based on an output from the mura correction circuitry.

9. The display device according to claim 8, further comprises a memory configured to store the mura correction data, wherein the correction amount calculation circuitry is configured to read out the mura correction data to calculate the mura correction amount for the second grayscale value.

10. The display device according to claim 8, wherein the lookup table circuitry is configured to convert the first DBV inputted thereto into a conversion coefficient used to convert the mura correction data into the mura correction amount for the second grayscale value, and wherein the correction amount calculation circuitry is configured to perform processing on the conversion coefficient and the mura correction data to calculate the mura correction amount.

11. The display device according to claim 8, wherein the lookup table circuitry comprises:

a register configured to store conversion coefficients respectively associated with a plurality of DBVs; and processing circuitry configured to:

receive the first DBV; and calculate a first conversion coefficient for the first DBV based on a linear interpolation of the plurality of DBVs and the conversion coefficients.

12. The display device according to claim 11, wherein the first conversion coefficient is a minimum conversion coefficient for the first DBV which is smaller than a predetermined DBV.

13. The display device according to claim 8, wherein the second DBV is a maximum DBV.

14. The display device according to claim 8, wherein the first DBV includes an externally received DBV.

15. A method, comprising:

calculating a second grayscale value for a second display brightness value (DBV), a bright less level corresponding to the second grayscale value corresponds to a brightness level corresponding to a first grayscale value and a first DBV, wherein the first DBV differs from the second DBV; and calculating a mura correction amount based on a mura correction data for the second grayscale value and the second DBV.

16. The method according to claim 15, further comprising:

storing the mura correction data into a memory, wherein the calculating the mura correction amount comprises:

calculating the mura correction amount using the mura correction data read out from the memory.

17. The method according to claim 15, wherein the calculating the mura correction amount comprises:

converting the first DBV inputted to lookup table circuitry into a conversion coefficient used to convert the mura correction data into the mura correction amount for the second grayscale value; and performing processing on the conversion coefficient and the mura correction data to calculate the mura correction amount.

18. The method according to claim 17, further comprising:

storing conversion coefficients respectively associated with a plurality of DBVs, wherein the calculating the mura correction amount comprises:

receiving the first DBV; and calculating a first conversion coefficient for the first DBV based on a linear interpolation of the plurality of DBVs and the conversion coefficients.

19. The method according to claim 18, wherein the first conversion coefficient is a minimum conversion coefficient for the first DBV which is smaller than a predetermined DBV.

20. The method according to claim 15, wherein the second DBV is a maximum DBV.

* * * * *